US005916471A

United States Patent [19]

Hall

[11] Patent Number: 5,916,471

[45] Date of Patent: Jun. 29, 1999

[54] ROTARY SOCKET TAPHOLE ASSEMBLY

[75] Inventor: Richard G. Hall, Hiram, Ohio

[73] Assignee: North American Refractories Co., Cleveland, Ohio

[21] Appl. No.: 09/189,458

[22] Filed: Nov. 10, 1998

[51] Int. Cl.[6] ..... B22D 41/00

[52] U.S. Cl. ..... 222/591; 222/594; 65/324; 266/236

[58] Field of Search ..... 222/590, 591, 222/594, 598, 599; 266/236, 240, 275, 45, 218; 65/324, 325

[56] References Cited

U.S. PATENT DOCUMENTS

| | | | |
|---|---|---|---|
| 3,463,475 | 8/1969 | Buchholz | 266/275 |
| 3,467,369 | 9/1969 | Shindo | 266/236 |
| 3,760,992 | 9/1973 | Bieri | 222/512 |
| 4,328,956 | 5/1982 | LaLama et al. | 266/275 |
| 4,728,012 | 3/1988 | Monks | 222/598 |
| 4,732,304 | 3/1988 | Yoshihara | 222/598 |
| 4,840,295 | 6/1989 | Hartley | 222/598 |
| 4,932,570 | 6/1990 | Gimpera | 222/599 |
| 4,984,769 | 1/1991 | Bruckner et al. | 266/236 |
| 5,249,717 | 10/1993 | Inubushi et al. | 222/598 |
| 5,603,859 | 2/1997 | Wallis | 222/598 |

*Primary Examiner*—Scott Kastler
*Attorney, Agent, or Firm*—Mark Kusner

[57] ABSTRACT

A taphole assembly for a vessel containing a molten solid. The assembly is comprised of a tubular element formed of a refractory material. The tubular element has a continuous passage extending therethrough along a first axis. A socket block formed of a plurality of mating refractory components is provided to hold the tubular element. The socket block has a first convex cylindrical surface on one side thereof and a second convex cylindrical surface on an opposite side thereof. The first and the second cylindrical surfaces are defined about a second axis extending through the socket block. The socket block has an inner cavity dimensioned to receive and to capture the tubular element. A first rectangular saddle block has a first concave recess formed therein that is dimensioned to match and to receive the first convex surface on the socket block. A second rectangular saddle block has a second concave recess formed therein that is dimensioned to match and to receive said second convex surface on the socket block.

3 Claims, 4 Drawing Sheets

ROTARY SOCKET TAPHOLE ASSEMBLY

FIELD OF THE INVENTION

The present invention relates generally to taphole designs for vessels containing molten solids, and more particularly, to a taphole assembly for furnaces containing molten metal.

BACKGROUND OF THE INVENTION

Most metal melting, furnaces are formed of a metallic shell having an inner refractory lining that separates and insulates the metallic shell from the molten metal contained within the furnace. The refractory linings are generally formed by refractory bricks that are stacked along the inner surface of the metallic shell. The depth of the bricks (i.e. the thickness of the refractory lining) varies depending upon the type of furnace and the type of molten metal to be contained therein.

In the steel making industry, to allow the tapping of molten steel or iron from the furnace, refractory components conventionally referred to as "taphole sleeves" are provided in the side of the furnace. A taphole sleeve is generally a cylindrical tube formed of a refractory material that has a passage or bore extending therethrough. The taphole sleeve is generally positioned within the furnace wall below the surface of the molten metal so that when the molten metal is tapped, impurities that usually float on the surface of the molten metal bath will not be removed through the taphole. The taphole sleeve thus extends through the furnace wall (i.e., through the metallic shell and the refractory lining).

Tapholes vary in size and length from furnace to furnace, and therefore are generally custom made for particular furnaces and applications. In addition, the orientation of a taphole in a furnace wall (i.e., the angle at which the taphole sleeve extends through the furnace wall) varies from one furnace to another. In this respect, in addition to providing a passage through the furnace wall, the taphole sleeve must be oriented to direct the molten metal along a specific path into a receptacle, such as a ladle or the like. In many operations, the impact point of the stream of molten metal within a receptacle must be carefully controlled. Thus, the orientation of the taphole sleeve in the furnace wall is very important.

Conventionally, taphole sleeves are positioned and held within a furnace wall within a block of a castable refractory material. Typically, the taphole sleeve is placed into its desired position and orientation, and a refractory castable material is cast or rammed around it to hold it in place. This casting procedure typically requires the use of forms so that the resulting cast block will have external, planar surfaces on and against which the refractory bricks forming the refractory lining may be stacked.

As will be appreciated, the positioning of a taphole sleeve in accordance with the foregoing procedure is labor-intensive, time-consuming and costly. Moreover, the refractory castable used to secure taphole sleeves typically does not have the strength and refractory characteristics possessed by pressed refractory bricks, and therefore may be more susceptible to failure.

The present invention overcomes these and other problems by providing a modular taphole sleeve assembly formed of pressed refractory components, wherein the orientation of the sleeve relative to the assembly is adjustable, and wherein the assembly has planar, rectilinear, peripheral surfaces on and against which refractory bricks may be stacked.

SUMMARY OF THE INVENTION

In accordance with the present invention, there is provided a taphole assembly for a vessel containing a metal. The assembly includes a tubular element formed of a refractory material. The tubular element has a continuous passage extending therethrough along a first axis. The assembly also includes a socket block formed of a plurality of mating refractory components. The socket block has a first convex cylindrical surface on one side thereof, and a second convex cylindrical surface on an opposite side thereof. The first and second cylindrical surfaces are defined about a second axis extending through the socket block. The socket block has an inner cavity dimensioned to receive and to capture the tubular element. The cavity is disposed such that the passage through the tubular element also extends through the socket. In addition, the passage through the tubular element is generally transverse to the second axis of the socket block. The assembly further includes a first rectangular saddle block and a second rectangular saddle block. The first rectangular saddle block has a first concave recess formed therein, wherein the first concave recess is dimensioned to match and to receive the first convex surface on the socket block. The second rectangular saddle block has a second concave recess formed therein dimensioned to match and receive the second convex surface on the socket block.

It is an object of the present invention to provide a taphole assembly for a vessel containing molten metal.

Another object of the present invention is to provide a taphole assembly as described above having a taphole sleeve, the orientation of which is adjustable within the assembly.

Another object of the present invention is to provide a taphole assembly as described above that is formed of pressed refractory components.

A still further object of the present invention is to provide a taphole assembly as described above that is modular and is adapted to receive taphole sleeves having various lengths and having various internal bore configurations.

A still further object of the present invention is to provide a taphole assembly as described above having planar, rectilinear, peripheral surfaces on and against which rectangular refractory bricks may be stacked.

These and other objects and advantages will become apparent from the following description of a preferred embodiment of the invention, taken together with the accompanying drawings.

BRIEF DESCRIPTION OF THE DRAWINGS

The invention may take physical form in certain parts and arrangement of parts, a preferred embodiment of which will be described in detail in the specification and illustrated in the accompanying drawings, wherein.

DETAILED DESCRIPTION OF PREFERRED EMBODIMENT

Figure 1:
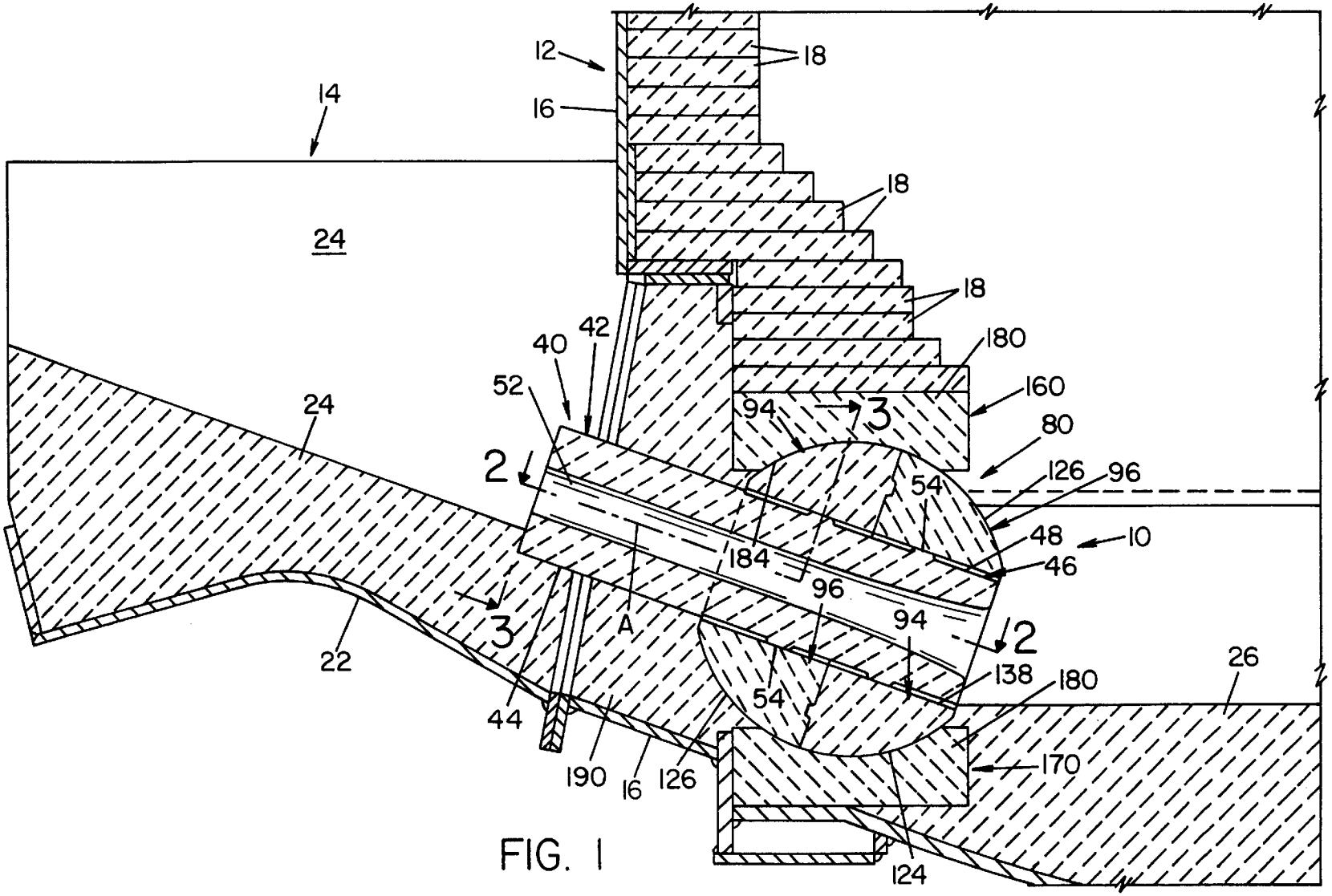
FIG. 1 is a sectional view showing a portion of a typical furnace showing a taphole assembly illustrating a preferred embodiment of the present invention.
Figure 2:
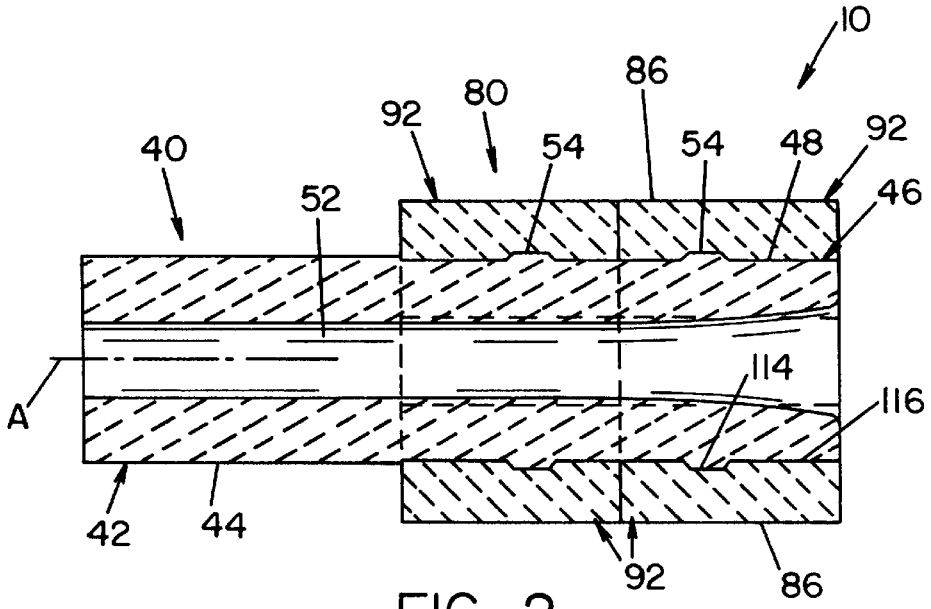
FIG. 2 is a sectional view taken alone lines 2—2 of FIG. 1.

Referring now to the drawings wherein the showings are for the purpose of illustrating a preferred embodiment of the invention only, and not for the purpose of limiting same, FIG. 1 shows a rotary taphole sleeve assembly 10, illustrating a preferred embodiment of the present invention. Taphole assembly 10 is illustrated positioned within a furnace wall 12 to be aligned with a runner 14. Furnace wall 12 is comprised of an outer structural shell 16 and a plurality of refractory bricks 18 of varying sizes that line the inner surface of structural shell 16. Runner 14 is also formed of an outer metal shell 22, and includes an inner refractory lining 24 that lines the bottom and sides of runner 14.

Figure 4:
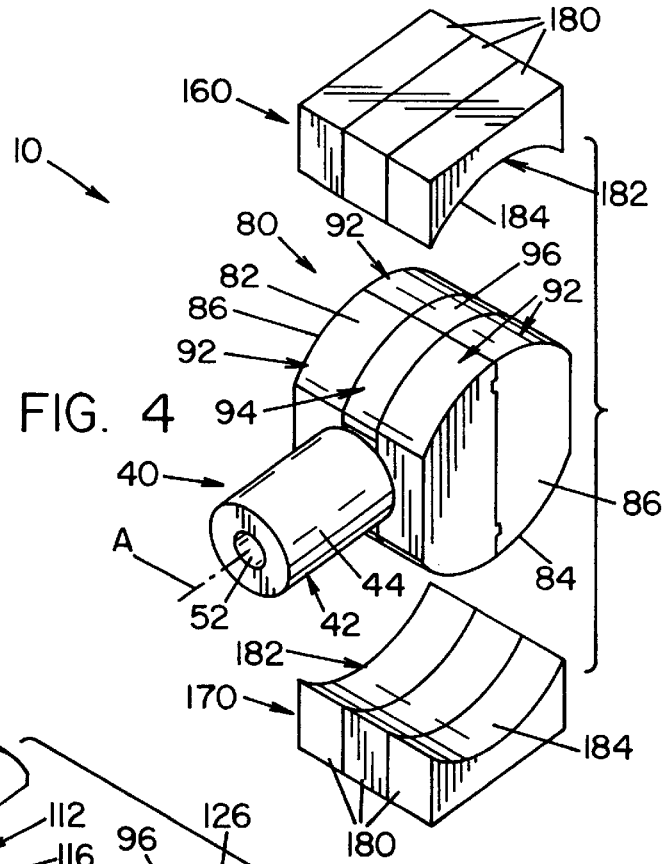
FIG. 4 is a vertically exploded view of the taphole assembly shown in FIG. 1.

Broadly stated, rotary taphole assembly 10 is comprised of a taphole sleeve 40 that is contained within a socket assembly designated 80, best seen in FIG. 4. Socket assembly 80 is disposed between a plurality of saddle blocks designated 160, 170. In FIG. 1, assembly 10 is shown forming part of furnace wall 12, with the lowermost portion of assembly 10 imbedded within a monolithic or pressed refractory material 26 that forms the bottom furnace lining. The upper portion of assembly 10 supports refractory bricks 18. Assembly 10 is disposed within furnace wall 12 to be aligned with runner 14 and to direct molten metal from the interior of the furnace to runner 14.

Figure 5:
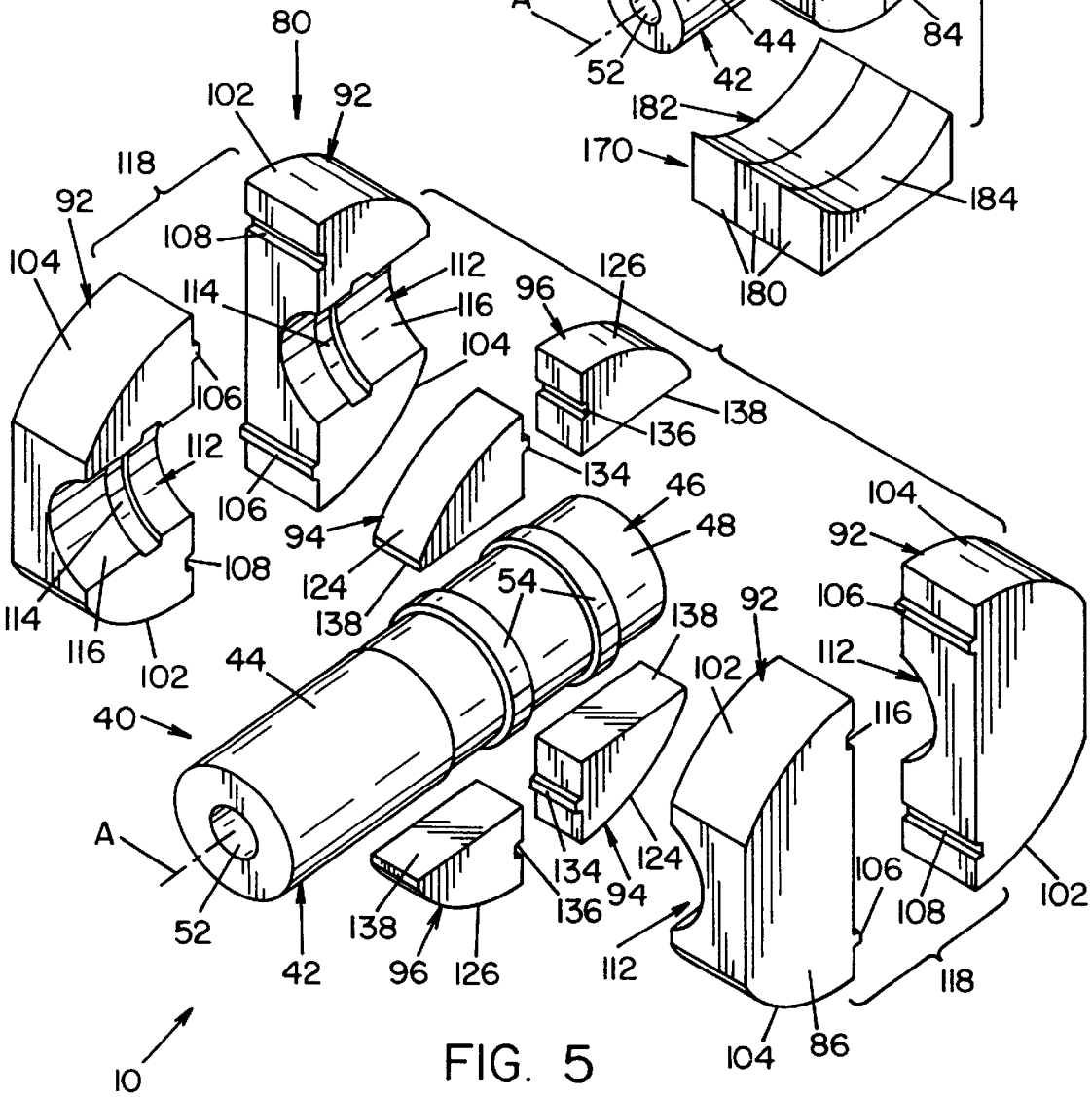
FIG. 5 is a fully exploded view of the taphole assembly shown in FIG. 1.

Referring now more specifically to assembly 10, in the embodiment shown, taphole sleeve 40, best seen in FIG. 5, is a cylindrical tube having a first end 42 having an outer cylindrical surface 44 and a second end 46 having an outer cylindrical portion 48, wherein second end 46 has a diameter slightly less than the diameter of first end 42, as best seen in FIG. 1. A bore or passage 52 extends through sleeve 40. Bore 52 is slightly funnel-shaped at the second end 46 of sleeve 40, i.e., the end of sleeve 40 within the furnace, as best seen in FIG. 1. Taphole sleeve 40 is symmetrical with respect to an axis, designated A in the drawings. In the embodiment shown, a pair of spaced apart, annular ribs 54 projects from outer cylindrical surface 48 of taphole sleeve 40.

Referring now to FIGS. 4 and 5, socket assembly 80 is best illustrated. Socket assembly 80 is comprised of a plurality of formed segments adapted to capture sleeve 40. As best illustrated in FIG. 4, socket assembly 80 has a convex upper surface 82, a convex lower surface 84, and planar sides 86. In the embodiment shown in FIGS. 1–5, socket assembly 80 is comprised of eight (8) socket segments. Four (4) of the socket segments, designated 92 in the drawings, are identical in shape; two (2) of the socket segments, designated 94 in the drawings, are identical in shape; and two (2) of the socket segments, designated 96 in the drawings, are identical in shape.

Each socket segment 92, 94 and 96 is basically a block formed of a refractory material, the refractory material being selected for the particular application and use of the furnace in which assembly 10 will be used. Segments 92, 94 and 96 are preferably formed by a pressing process, such as hydraulic pressing as is conventionally known.

Since each of the eight socket segments forming socket assembly 80 has one of three different shapes, only one of each segment shall be described in detail, it being understood that such a description applies equally to the other like segments (and that like structures shall be described with like reference numbers).

Each segment 92 has opposed arcuate surfaces, designated 102, 104. Arcuate surfaces 102, 104 are dimensioned to have the same radius of curvature. A tongue 106 and a groove 108 are formed along one face of segment 92. Tongue 106 and groove 108 on segment 92 are spaced such that segment 92 will interlock with an adjacent segment 92, as illustrated in FIGS. 4 and 5. A cavity 112 is formed within segment 92. Cavity 112 is dimensioned to have a radius of curvature approximately equal to the radius of curvature of cylindrical surface 48 on sleeve 40. A slot 114 is formed within the surface 116 of cavity 112. Slot 114 is dimensioned to receive a rib 54 on sleeve 40. In this respect, slot 114 in each segment 92 is disposed such that when adjacent segments 92 are joined, the spacing between slot 114 is equal to the spacing of annular ribs 54 on sleeve 40, wherein sleeve 40 will be received within the cylindrical cavity 112 of a segment 92, with annular ribs 54 being received within slot 114.

As indicated above, segments 92 are identical to each other and are dimensioned such that two segments 92 will interlock with each other. In this respect, two segments 92, when joined together, basically define a circular plate 118 having a cylindrical cavity 112 extending therealong. The other set of segments 92, when joined together, define an opposing plate 118. As indicated, cylindrical cavities 112 defined within opposing plates 118 are dimensioned to capture taphole sleeve 40.

The dimensions of plates 118 are such that they do not totally enclose sleeve 40, but rather define a space or gap therebetween. Segments 94 and 96 are provided to fill the gap defined between plates 118. Segments 94 and 96 are preferably formed of the same refractory material as segments 92 and are formed in a like manner. Segments 94 and 96 include arcuate surfaces 124, 126, each having a radius of curvature equal to the radius of curvature of surfaces 102 and 104 on segment 92. Segment 96 includes a socket 136 dimensioned to receive a tongue 134 formed on segments 94. Together, segments 94 and 96 define intermediate plates adapted to be disposed above and below sleeve 40 between plates 118, as best seen in FIG. 1. As shown in FIGS. 1 and 5, in the embodiment shown, segments are dimensioned to have a planar surface 138 that abuts the surface of annular ribs 54 on sleeve 40.

Together, segments 92, 94 and 96 define socket assembly 80 as shown in FIG. 4, with sleeve 40 captured therein. When assembled, arcuate surfaces 102, 104, 124 and 126 of socket segments 92, 94 and 96 are aligned and define a convex upper surface 82 and a convex lower surface 84 of socket assembly 80. In the embodiment shown, both convex surfaces 82, 84 are cylindrical in shape and are defined by a radius through the center of socket assembly 80.

Figure 3:
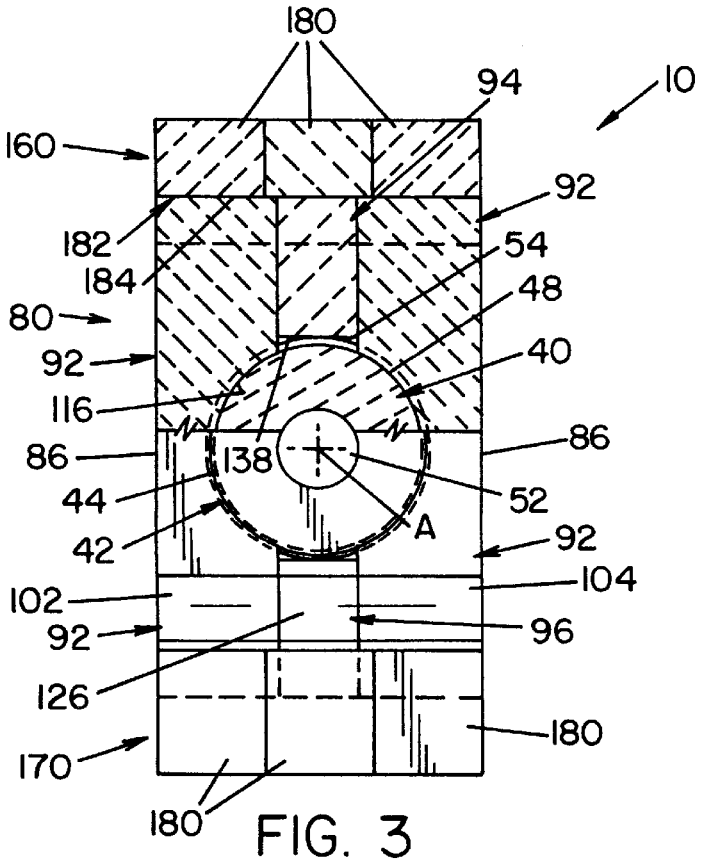
FIG. 3 is a sectional view taken along lines 3—3 of FIG. 1.

Socket assembly 80 is dimensioned to be captured between an upper saddle block assembly 160 and a lower saddle blocks assembly 170. In the embodiment shown, each saddle block assembly 160, 170 is comprised of three identical saddle blocks 180. Since each saddle block 180 is identical, only one shall be described, it being understood that such a description applies equally to the other saddle blocks 180. Each saddle block 180 is basically a rectangular block having outer planar surfaces and a concave recess 182 formed in one side thereof. Concave recess 182 defines a cylindrical surface 184 having a radius of curvature dimensioned to mate with the radius of curvature of the arcuate surfaces 124 and 126 of socket assembly 80. In this respect, when saddle block assemblies 160, 170 are positioned above and below socket assembly 80, recesses 182 receive socket assembly 80 as best illustrated in FIG. 1. Importantly, when assembled the outward facing, peripheral surfaces of assembly 10 are planar and parallel to each other, as best seen in FIG. 3, to facilitate the positioning of rectangular refractory brick on or against the surfaces of socket assembly 10.

Referring now to the operation of assembly 10, as indicated above, taphole assembly 10 is adapted for use to convey molten metal from a furnace through a furnace wall. In this respect, the orientation of taphole sleeve 40, as well as the position of sleeve 40 within a furnace wall typically varies from furnace to furnace based upon the type and design of furnace used and the application to which the sleeve 40 will be exposed. In other words, the position and orientation of taphole sleeve 40 is generally specific for a specific furnace. An assembly 10, in accordance with the present invention, facilitates more rapid installation of taphole sleeve 40 in the furnace.

In accordance with the present invention, it is envisioned that assembly 10 may be provided to the user in an assembled state or as components to be assembled at the installation site. With respect to the former, if the angle or orientation of the taphole sleeve 40 is known, socket assembly 80 and sleeve 40 may be assembled and secured together with saddle blocks 160, 170 at the factory, and shipped as a unit to the job site to be installed within a furnace. Because the orientation of the taphole sleeve 40 would be established relative to the horizontal surfaces of the upper and lower saddle block assemblies 160, 170, at the installation site, the user need only position assembly 10 at the desired elevation to properly position assembly 10 and sleeve 40 within the furnace. In this respect, because of the planar lower surface of saddle block assembly 170, conventional planar bricks may be used to establish the proper elevation and assembly 10 set thereon. Once in place, because of the planar upper surface and planar sides of assembly 10, completion of the refractory lining would require merely stacking conventional rectangular refractory bricks onto and against taphole assembly 10. The use of forms or fixtures typically used to position the sleeve 40 would not be required.

In similar respects, the assembly may be provided to the end user as individual components, wherein the user may position the lower saddle block assembly 170 at a desired elevation within the furnace, by either placing it upon stacked refractory bricks or casting it in place as part of the lower refractory lining, as illustrated in FIG. 1. Once the proper elevation of lower saddle block assembly 170 is established, socket assembly 80 and sleeve 40 may be assembled and set in place and positioned to its proper orientation. Thereafter, upper saddle block assembly 160 may be positioned on socket assembly 80 and the remaining lining built up by stacking conventional refractory bricks onto the planar surface of the upper saddle block assembly 160 or against the planar vertical surfaces of assembly 10.

In many installations, in addition to stacking refractory brick above, below and around the assembly, a cavity may exist around the exposed portion of sleeve 40. It is known to fill such cavity with a refractory castable to provide additional insulation in this vicinity and to secure the sleeve in place. In FIG. 1, such a cavity is shown and designated 190. Once assembly 10 is in place, and refractory bricks 18 are stacked thereon, the filling of cavity 190 requires no additional forming.

With respect to securing the respective components of assembly 10 together at the installation site or at the point of manufacture, it has been found that the respective assembly components may be bonded by a resinous material, such as epoxies, urethanes, cyanoacrylates or solvent or water based adhesives having sufficient strength to maintain the components in a given configuration during manufacture, shipping or installation. Epoxies, i.e., polyether resins formed by the polymerization of bisphenol A and epichlorohydrin, provide suitable adhesives for such use. An epoxy resin sold under the name Locktite 330 has been found to provide satisfactory bonding for securing the respective components together during manufacture, shipping or installation. It will be appreciated that the bonding material is used primarily to provide dimensional stability during assembly and shipping. Once set in place, assembly 10 is locked into position by the adjacent bricks and refractory material and the resinous bonding material burns away when exposed to elevated temperatures.

The present invention thus provides a modular taphole sleeve assembly 10 which provides for more rapid assembly and installation of a taphole sleeve in a furnace wall. Moreover, because of the modular construction, socket assembly 80 and saddle block assembly 160, 170 may be used with a number of different types of taphole sleeves 40, which sleeves 40 may be formed of various lengths and have various bore 52 diameters to accommodate a specific application or use. So long as second end 46 of sleeve 40 and annular ribs 54 thereon are dimensioned to mate with the mating surfaces on socket assembly 80, assembly 10 would find advantageous application for a wide variety of applications and uses by merely replacing and designing sleeve 40 to meet such application and use.

Figure 6:
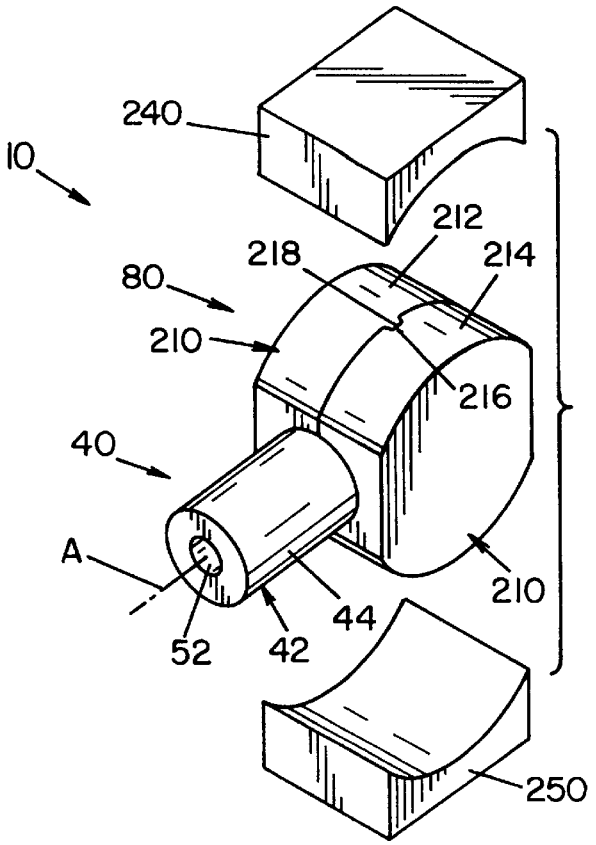
FIG. 6 is a perspective view of a taphole sleeve and a socket illustrating an alternate embodiment of the present invention.
Figure 7:
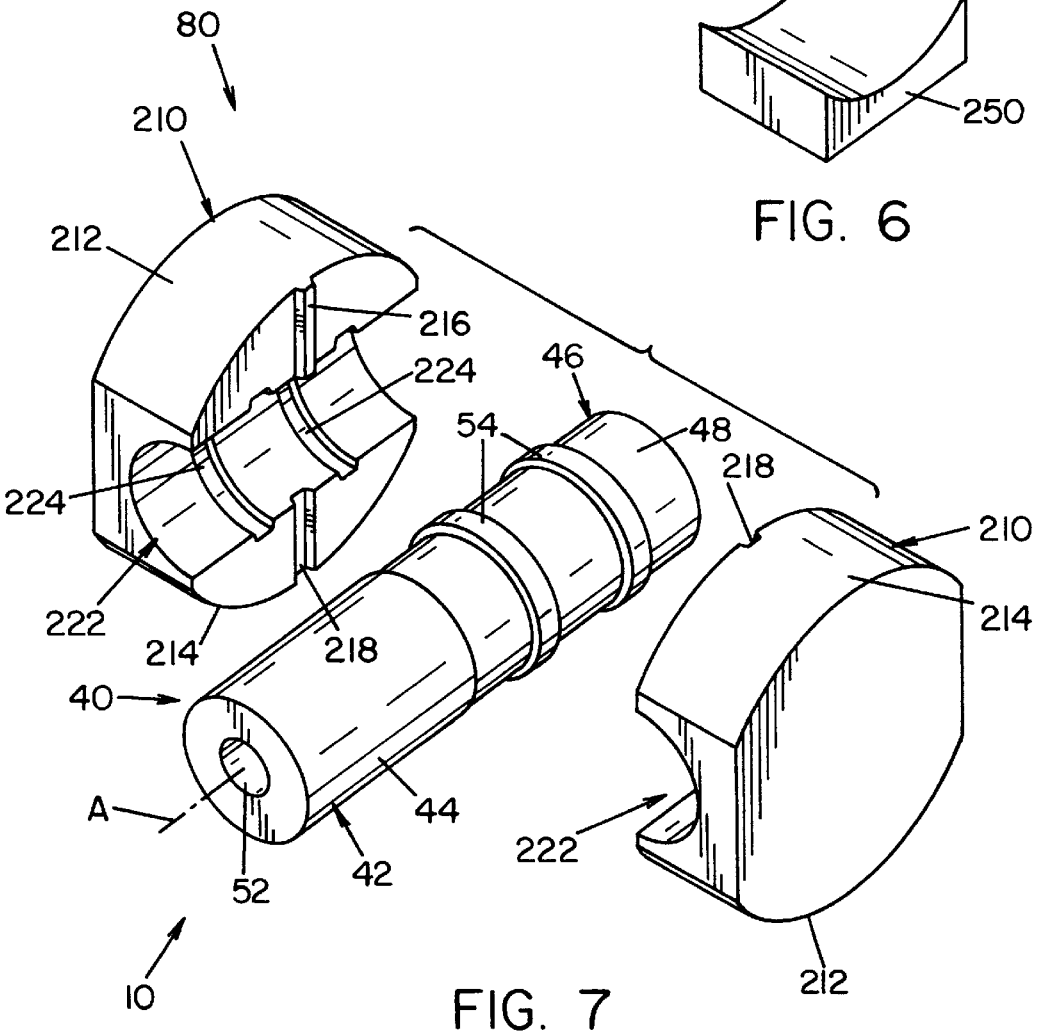
FIG. 7 is an exploded view of the taphole sleeve and socket shown in FIG. 6.

The embodiment shown in FIGS. 1–5 discloses a socket assembly 80 and saddle blocks 160, 170 formed of a plurality of individual segments. This particular embodiment is the result of limitations based upon forming equipment. In this respect, a typical sleeve 40, as shown in FIGS. 1–5, would be approximately 4 feet in length. As will be appreciated, in relation, segments 92, 94 and 96 are relatively large and require a relatively large hydraulic press and die to form same. In the embodiment shown, a single die is used to form all of the socket segments 92, 94 and 96. In this respect, it should also be noted from the drawings that the shape of segments 94 and 96 are defined within the shape of a segment 92. In other words, by blocking off portions of the die used in forming segment 92, segments 94 and 96 may be formed utilizing the same die. Accordingly, the number of components disclosed in the embodiment shown in FIGS. 1–5 for forming socket assembly 80 are the result of forming limitations and, in and of themselves, do not limit the present invention. Ideally, socket assembly 80 is formed of two identical components as shown in FIGS. 6 and 7. In FIGS. 6 and 7, two identical segments designated 210 form socket assembly 80. As best seen in FIG. 7, each socket element 210 includes a first convex surface 212 and a second convex surface 214 and a tongue 216 to be received within a matching groove 218 in opposing segment 210. A cylindrical cavity 222 is formed in one side of block 210 and has grooves 224 formed therein to receive the second end 46 of sleeve 40. As with the embodiment shown in FIGS. 1–5, socket segments 210 are dimensioned to capture sleeve 40. Similarly, the upper and lower saddle blocks 240, 250 for receiving the socket/sleeve assembly 210 may likewise be formed of a single refractory component.

The foregoing description relates to preferred embodiments of the present invention. It should be appreciated that these embodiments are described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. A taphole assembly for a vessel containing a molten solid, said assembly comprised of:

a tubular element formed of a refractory material, said tubular element having a continuous passage extending therethrough along a first axis;

a socket block formed of a plurality of mating refractory components, said socket block having a first convex cylindrical surface on one side thereof and a second convex cylindrical surface on an opposite side thereof, said first and said second cylindrical surfaces being defined about a second axis extending through said socket block, said socket block having an inner cavity dimensioned to receive and to capture said tubular element, said cavity disposed such that said continuous passage extends through said socket and is generally transverse to said second axis of said socket block;

a first rectangular saddle block having a first concave recess formed therein, said first concave recess dimensioned to match and to receive said first convex surface on said socket block; and a second rectangular saddle block having a second concave recess formed therein, said second concave recess dimensioned to match and to receive said second convex surface on said socket block.

2. A taphole assembly as defined in claim 1, wherein said first convex cylindrical surface and said second convex cylindrical surface have the same radius of curvature.

3. A taphole assembly as defined in claim 1, wherein said tubular element is generally cylindrical in shape.

* * * * *